United States Patent [19]

Theurer

[11] 4,178,236

[45] Dec. 11, 1979

[54] MOBILE APPARATUS FOR RECEIVING AND CONVEYING FERROUS RAIL FASTENING ELEMENTS

[75] Inventor: Josef Theurer, Vienna, Austria

[73] Assignee: Franz Plasser Bahnbaumaschinen-Industriegesellschaft m.b.H., Vienna, Austria

[21] Appl. No.: 898,143

[22] Filed: Apr. 20, 1978

[30] Foreign Application Priority Data

Aug. 29, 1977 [AT] Austria ..... 6237/77

[51] Int. Cl.[2] ..... B03C 1/12

[52] U.S. Cl. ..... 209/215; 104/1 R

[58] Field of Search ..... 209/215, 218, 219, 38, 209/420, 421; 214/353; 171/16; 198/510, 506, 690; 37/104; 104/1 R, 2, 17 R, 279

[56] References Cited

U.S. PATENT DOCUMENTS

| | | | |
|---|---|---|---|
| 3,690,264 | 9/1972 | Plasser et al. | 104/17 R |
| 3,709,360 | 1/1973 | Baker | 209/218 X |
| 3,731,455 | 5/1973 | Theurer | 104/1 R X |
| 3,858,359 | 1/1975 | Leliaert | 209/215 X |

*Primary Examiner*—Ralph J. Hill

*Attorney, Agent, or Firm*—Kurt Kelman

[57] ABSTRACT

A mobile apparatus for receiving and conveying ferrous rail fastening elements comprises a track-bound carriage, a carrier frame mounted vertically adjustably on the carriage, magnetic drums mounted on the carrier frame and associated with the rails laterally thereof at both sides of the rails, each magnetic drum including a drive for rotation of the drum about an axis extending transversely to the track, and an endless conveyor band trained about each magnetic drum and having entrainment elements for the rail fastening elements. A conveyor band arrangement is mounted on the carriage and associated with the magnetic drums rearwardly thereof in the operating direction.

9 Claims, 2 Drawing Figures

MOBILE APPARATUS FOR RECEIVING AND CONVEYING FERROUS RAIL FASTENING ELEMENTS

Figure 1:
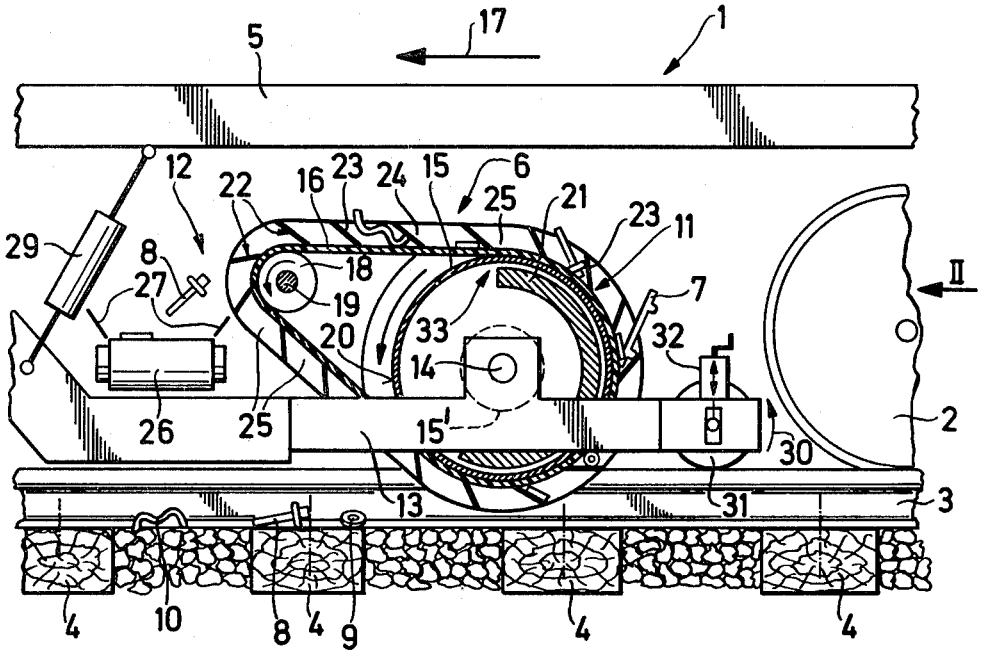

The present invention relates to mobile apparatus for receiving and conveying ferrous rail fastening elements disposed on the surface of a ballast bed on which two rails of a track rest.

U.S. Pat. No. 3,690,264, dated Sept. 12, 1972, discloses a mobile track working apparatus for use in track renewal operation, wherein previously disassembled rail fastening elements, such as bolts, spikes, tie plates, clamps and the like, may be picked up by magnetic drums or slides guided along the surface of the ballast bed, and the received rail fastening elements may be transferred from the magnetic drums or slides to an endless conveyor band which conveys them to a storage bin on a carriage mounted for mobility in an operating direction on two rails of a track resting on the ballast bed. While this apparatus is useful for its purpose, the surfaces of the magnetic drums or slides in contact with the ballast bed as they are guided along its surface are subject to considerable wear and deformations, due to projecting ballast pieces or bulky fastening elements.

According to U.S. Pat. No. 3,731,455, dated May 8, 1973, loose rail fastening elements may be picked up by magnetic conveyor means spaced fixedly from the ballast bed and the received fastening elements are then conveyed to a succession of receptacles on a mobile carriage. The filled receptacles require frequent replacement by empty ones, leading to interruptions in the operation.

It is the primary object of the present invention to provide a mobile apparatus of the indicated type but of improved operating capacity and reliable pick-up of ferrous rail fastening elements of various shapes during a non-stop advancement of the apparatus along the track.

The above and other objects are accomplished in accordance with this invention with a carriage mounted for mobility in an operating direction on two rails of a track resting on the ballast bed, a carrier frame mounted vertically adjustably on the carriage, magnetic drums mounted on the carrier frame, the magnetic drums being associated with at least one of the rails and extending laterally thereof at both sides of the rail, each of the magnetic drums including a drive for rotation of the drum about an axis extending transversely to the track, and an endless conveyor band trained about each of the magnetic drums, the conveyor band having entrainment elements for the rail fastening elements. A conveyor band arrangement is mounted on the carriage and associated with the magnetic drums rearwardly thereof in the operating direction.

With the apparatus of the invention, the ferrous rail fastening elements are picked up and conveyed away from the ballast bed not only by the positively driven magnetic drums but, additionally, by the entrainment elements on the endless conveyor band as the same moves first up and then forwardly. More particularly, the upwardly moving entrainment elements support the picked-up fastening elements as the magnetic drums rotate and thus prevent any accidential dropping of fastening elements off the periphery of the drum, due to insufficient magnetic attraction. In this manner, the described combination of the present invention assures a reliable pick-up and transport of the rail fastening elements under all circumstances, even if the elements are relatively heavy and/or there is a large local concentration of such elements on the ballast bed or on a tie.

The entrainment elements on the endless conveyor band trained about the magnetic drum also avoid the possibility that the magnetic attraction over the lower portions of the drum causes the upwardly moved ferrous rail fastening elements to be pulled back again from the upper region of the drum, which is non-magnetic and whence the picked-up fastening elements are released to be transported by the conveyor band arrangement. In addition, the entrainment elements on the endless conveyor in the pick-up region where the fastening elements are first received from the ballast bed tend to sort the fastening elements for their further conveyance in the operating direction and to facilitate the transfer of the fastening elements from the drums to the conveyor band arrangement.

Because, furthermore, the magnetic drums are out of contact with the surface of the ballast bed and of the ties so that no fastening element, however disposed and of whatever size, may be jammed therebetween, the relatively thin walls or skins of the magnetic drums are not subjected to damage and repair work required by rapid wear is substantially reduced, the drum walls being further protected by the endless conveyor band trained thereover. This operating reliability and high capacity makes the apparatus of the present invention particularly useful in combination with track renewal trains whose operating speed depends on the reliability of all the track working apparatus incorporated into the train.

Figure 2:
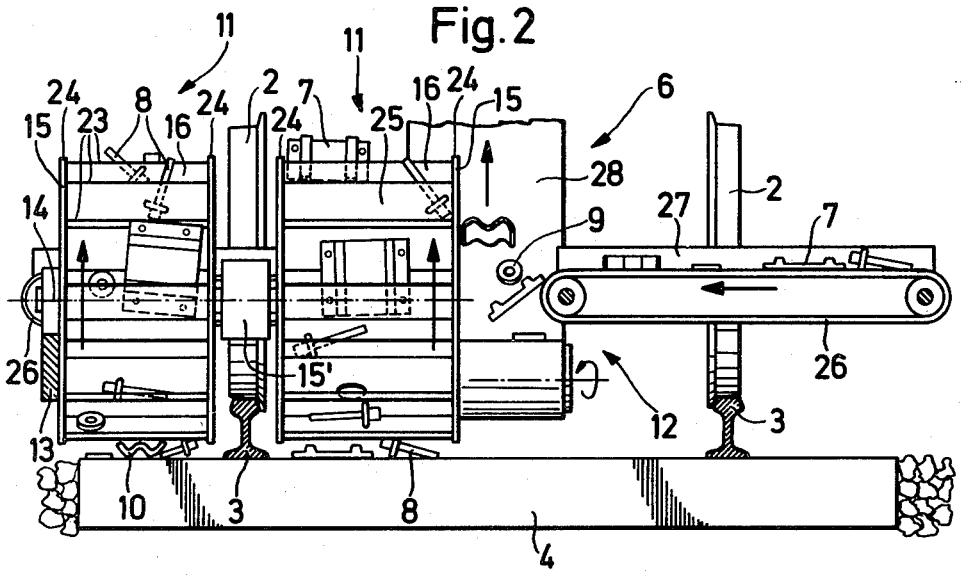

The above and other objects, advantages and features of this invention will become more apparent from the following description of a now preferred embodiment thereof, taken in conjunction with the accompanying schematic drawing wherein FIG. 1 is a partial side elevational view, partly in section, showing the essential parts of the mobile apparatus of the invention; and FIG. 2 is an end view of the apparatus, taken in the direction of arrow II of FIG. 1.

In the illustrated embodiment, the apparatus of the present invention is incorporated into the apparatus for receiving and conveying ferrous rail fastening elements, which is disclosed in my concurrently filed patent application, Ser. No. 898,144 of the same title, the entire disclosure thereof being incorporated herein by reference.

Referring now to the drawing, the mobile apparatus for receiving and conveying ferrous rail fastening elements 8, 9, 10 disposed on the surface of the ballast bed and of ties 4 comprises carriage 1 mounted on undercarriages 2 for mobility in an operating direction indicated by arrow 17 on two rails 3 on a track having ties 4 resting on the ballast bed. Carriage 1 has a frame 5 and carrier frame 13 is mounted vertically adjustably on carriage 1 and carries apparatus 6 designed to pick up loose ferrous rail fastening elements and to move them off the ballast bed and the ties on which they are disposed.

Apparatus 6 is comprised essentially of a series 11 of transversely aligned magnetic drums 15 mounted on one end of carrier frame 13, two magnetic drums being associated with each of the rails and extending laterally thereof at both sides of the rail, and an endless conveyor band 16 trained about each magnetic drum 15 and having entrainment elements 22 for the rail fastening elements. Conveyor band arrangement 12 is mounted on the carriage and is associated with the apparatus 6 rearwardly of the magnetic drums 15 in the operating direction. In the illustrated embodiment, conveyor band arrangement 12 is also mounted on vertically adjustable carrier frame 13, the carrier frame being linked to carriage frame 5 by lifting drive 29, the mounting of the conveyor band arrangement and the pivoting of carrier frame 13 in relation to carriage frame 5 being full described and illustrated in the concurrently filed application.

In the illustrated magnetic drum arrangement 11, the two outer magnetic drums 15 sweep over the ballast bed regions extending alongside of the rails while the two inner magnetic drums sweep over the ballast bed region between the rails. Each pair of magnetic drums 15 associated with a respective rail 3 is supported by rotary driving axle 14 for rotation in a direction indicated by arrows, the driving axle being driven by a common drive 15' for each pair of drums, preferably a hydraulic drive capable of adjusting the rotary speed of magnetic drums 15. If desired, all four drums may be mounted on a common driving axle and this axle could be driven by a belt drive from a single power source.

In the preferred illustrated embodiment, endless conveyor band 16 is comprised of an elastic sheet material and is arranged in a substantially triangular conveying path, as shown in FIG. 1. For this purpose, apparatus 6 comprises pulley 18 having axis 19 extending substantially parallel to axis 14 of an associated magnetic drum 15, the pulley being arranged at a fixed distance from the associated drum and having a diameter substantially smaller than that of the associated drum. Endless conveyor band 16 is trained over pulley 18 and associated drum 15 for support thereby, and conveyor band arrangement 12 has a receiving end 26 associated with a discharge end of endless conveyor band 16 adjacent supporting pulley 18. This arrangement is particularly advantageous for the transport of the picked-up rail fastening elements and their transfer to the conveyor band arrangement 12. The relatively small diameter of support pulley 18 makes it possible to arrange it immediately adjacent and at a favorable distance above the receiving end of the conveyor band arrangement so that the rail fastening elements conveyed by endless conveyor band 16 are gravity-fed directly to transversely extending endless conveyor bands 26 which constitute the receiving end of conveyor band arrangement 12 in a manner fully described in the concurrently filed application. As also fully described therein, each magnetic drum 15 comprises coil core 21 stationarily mounted inside cylindrical wall 20 which is a relatively thin skin and is arcuately shaped over only a portion of the skin of non-magnetic material, which portion being limited substantially to that part of the drum periphery which is in contact with conveyor band 16 trained thereover.

In the illustrated embodiment, entrainment elements 22 are constituted by transverse members 23 arranged substantially equidistantly about the periphery of endless conveyor band 16 and enclosing an acute angle, for example 45° to 50°, with respect to the plane of the periphery in the operating direction. The endless conveyor band has upright lateral webs 24 defining pockets 25 with transverse entrainment members 23. Ferrous rail fastening elements 7, 8, 9, 10 are received and conveyed in these pockets. These pockets form closed conveying zones across the width of conveyor band 16 all along its periphery, the oblique positioning of transverse entrainment members 23 assuring reliable entrainment of the rail fastening elements from the pick-up point at the bottom of the magnetic drum. Tests have shown an inclination of 45° to 50° to be particularly advantageous. Any lateral displacement of rail fastening elements conveyed in pockets 25, particularly of bulky and heavy fastening elements, is prevented by lateral webs 24 extending along the side edges of endless conveyor band 16. In addition, the lateral webs increase the tensile strength and the operating life of elastic belts 16.

As fully described in the concurrent application, the preferred conveyor band arrangement 12 comprises a pair of endless receiving conveyor bands 26 extending substantially parallel to axes 14 and 19, and driven in a conveying direction towards the center of carriage 1, as shown by the arrow in FIG. 2 associated with conveyor 26, towards a discharge end thereof. The picked-up rail fastening elements are discharged from their conveying pockets 25 by gravity onto receiving conveyor bands 26 which have lateral guide sheets 27 to prevent lateral displacement of the fastening elements disposed on the conveyor bands. Endless main conveyor band 28 of arrangement 12 and receiving conveyor bands 26 are mounted on carrier frame 13, and the main conveyor band has an input end adjacent and underneath the discharge ends of conveyor bands 26 to receive the conveyed rail fastening elements therefrom and to convey them to a discharge end (not shown).

Vertically adjustable carrier frame 13 may be raised from the illustrated operating position by hydraulic drive means 29 in the direction of arrow 30 into a rest position desired, for example, when carriage 1 is moved over the track from one working site to another.

As shown in FIG. 2, the vertical position of magnetic drums 15 is so adjusted during operation that the drum skins project slightly below a plane defined by the running surfaces of rails 3, which has been found to be most efficient for the magnetic pick-up of ferrous rail fastening elements. For this purpose, rollers 31 supporting the one end of carrier frame 13 are vertically adjustably mounted on the carrier frame end, the illustrated adjustment being obtained by a spindle drive 32 which enable the roller axle to be vertically moved in relation to the carrier frame the rollers support on the rails, thus making adaptation to various rail heights very simple.

The above-described apparatus operates in the following manner:

Carriage 1 moves along the track in operating direction 17 either under its own power, if it is a self-propelled vehicle, or as part of a track renewal train, continuously or intermittently, depending on the rhythm of the operation. The magnetic drums and the conveyor bands are driven at speeds suitably adjusted to each other and, preferably, to the forward speed of carriage 1. Carrier frame 13 is lowered into the illustrated operating position and the coils of coil core 21 of magnetic drums 15 are energized. As the carriage moves along the track, the drum skin portions surrounding energized arcuate coil core 21 will pick up loose ferrous rail fastening elements 7, 8, 9, 10 disposed on the surface of the ballast bed or of the ties, and the rotating drums 15 will convey the magnetically attracted rail fastening elements in pockets 25 to the discharge zone at pulley 18 whence they will fall onto receiving conveyor bands 26 which convey the elements to main conveyor band 28.

What is claimed is:

1. A mobile apparatus for receiving and conveying ferrous rail fastening elements disposed on the surface of a ballast bed, which comprises (a) a carriage mounted for mobility in an operating direction on two rails of a track resting on the ballast bed, (b) a carrier frame mounted vertically adjustably on the carriage, (c) magnetic drums mounted on the carrier frame, the magnetic drums being associated with at least one of the rails and extending laterally thereof at both sides of the rail, (1) each of the magnetic drums including a drive for rotation of the drum about an axis extending transversely to the track, (d) an endless conveyor band trained about each of the magnetic drums, the conveyor band having (1) entrainment elements for the rail fastening elements, and (e) a conveyor band arrangement mounted on the carriage and associated with the magnetic drums rearwardly thereof in the operating direction.

2. The mobile apparatus of claim 1, wherein the entrainment elements are transverse members arranged substantially equidistantly about the periphery of the endless conveyor band.

3. The mobile apparatus of claim 2, wherein the transverse entrainment members enclose an angle of less than 90° with respect to the plane of the periphery in the operating direction.

4. The mobile apparatus of claim 2 or 3, further comprising lateral webs arranged on the endless conveyor band and defining pockets with the transverse entrainment members.

5. The mobile apparatus of claim 1, wherein the endless conveyor band is comprised of an elastic sheet material.

6. The mobile apparatus of claim 1 or 5, wherein the endless conveyor band is arranged in a substantially triangular conveying path.

7. The mobile apparatus of claim 6, further comprising a pulley having an axis extending substantially parallel to the axis of an associated one of the magnetic drums, the pulley being arranged at a fixed distance from the associated drum and having a diameter substantially smaller than that of the associated drum, the endless conveyor band being trained over the pulley and the associated drum for support thereby, and the conveyor band arrangement having a receiving end associated with a discharge end of the endless conveyor band adjacent the supporting pulley.

8. The mobile apparatus of claim 1, wherein the carriage has a frame and the vertically adjustably mounted carrier frame has two ends, further comprising rollers supporting one of the carrier frame ends for movement along the track rails, the magnetic drums being mounted on the one carrier frame end at a distance from the ballast bed.

9. The mobile apparatus of claim 8, wherein the rollers are vertically adjustable on the carrier frame for vertically adjusting the distance of the magnetic drums from the ballast bed.

* * * * *